United States Patent [19]

Datta

[11] Patent Number: 4,667,885

[45] Date of Patent: May 26, 1987

[54] PROCESS FOR GRINDING ORGANIC-CONTAINING MINERALS

[75] Inventor: Rabinder S. Datta, Pittsburgh, Pa.

[73] Assignee: Chevron Research Company, San Francisco, Calif.

[21] Appl. No.: 768,900

[22] Filed: Aug. 22, 1985

[51] Int. Cl.[4] ..... B02C 23/06; B02C 23/18

[52] U.S. Cl. ..... 241/16; 241/20; 241/21; 241/24; 241/29

[58] Field of Search ..... 241/15, 16, 20, 21, 241/24, 29, 30, 76, 80, 97

[56] References Cited

U.S. PATENT DOCUMENTS

| | | | |
|---|---|---|---|
| 4,264,352 | 4/1981 | Houser | 241/DIG. 38 X |
| 4,341,353 | 7/1982 | Hamilton et al. | 241/DIG. 38 X |
| 4,506,835 | 3/1985 | Tsai | 241/21 X |

*Primary Examiner*—Timothy V. Eley

*Attorney, Agent, or Firm*—S. R. LaPaglia; T. G. DeJonghe; Q. T. Dickinson

[57] ABSTRACT

A process for grinding organic-containing mineral matter, particularly oil shale, is disclosed comprising a series of increasing finer grind-producing grinding steps, each followed by an organic beneficiation step. A portion of the organic-enhanced beneficiation product is mixed with each successive grinding step feed.

23 Claims, No Drawings

PROCESS FOR GRINDING ORGANIC-CONTAINING MINERALS

BACKGROUND OF THE INVENTION

The eventual commercial production of shale oil in sufficient quantities to constitute a significant replacement of petroleum oil will involve the handling of enormous quantities of inert inorganic mineral refuse in the process of recovering the kerogen content from the oil shale. For example, commercially recoverable oil shale generally contains from about 85 percent to about 95 percent mineral matter, with the kerogen-rich material constituting a very minor proportion of the overall in-place oil shale.

Ordinarily, the first step in any oil shale process is to reduce the bulk material to a size that can be effectively processed. In particular, once it has been crushed to a size amenable for easier handling, the shale can be further ground to expose or begin to separate the desired kerogen found in the mineral matrix. Fine grinding is more particularly desirable when the shale is subjected to a beneficiation process to increase significantly the percentage of kerogen in the feed and remove most of the kerogen-poor mineral gangue. As a result, an economic process which significantly reduces the amount of oil shale which must be handled and treated to yield a given amount of kerogen and which significantly reduces the amount of polluting shale waste would be advantageous.

Various oil shale beneficiating procedures have been proposed. Those separations most proposed are predicated on the differential occurrence of kerogen in the various lumps, pieces and particles of oil shale following the various methods of size reduction and comminution. Since the larger pieces in a reduced shale tend to have a higher kerogen content, simple screening can effect a beneficiation, as described in U.S. Pat. No. 3,133,010. Since kerogen-rich particles possess a lower specific gravity, gravity separation in a dense liquid can also effect a moderate separation, as also mentioned in the reference above. Since kerogen-rich particles differ in wettability from kerogen-poor particles, separation in an aqueous medium by froth flotation is also a significant means of segregating kerogen from the inorganic mineral matter, one method of which is described in U.S. Pat. No. 3,973,734. Two particular beneficiating processes deriving significant advantage from the present invention are claimed in U.S. Patent Applications entitled "Process, for Beneficiating Oil Shale Using Froth Flotation", Ser. No. 768,901 Datta et al., and "Process for Beneficiating Oil Shale Using Selective Flocculation", Ser. No. 769,188 Datta et al., both filed contemporaneously herewith.

The intimate nature of the mineral-matter/kerogen in oil shale requires a complex size reduction procedure. Because of its anisotropy, i.e., having different properties in different axes, shale on comminution results in a coarser kerogen-rich fraction which is more resistant to grinding, and a kerogen-poor fraction. This selective fractionation of the oil shale may also be utilized profitably during its beneficiation.

SUMMARY OF THE INVENTION

The present invention comprises a process for grinding mineral matter, preferably oil shale, containing an appreciable organic portion to be separated out. It further comprises a series of grinding steps in which the mineral matter is ground to particles of a desired average size and separated into larger and smaller than average size fractions. The smaller-than-average size fraction is processed in a beneficiation process which yields an organic-enhanced fraction. All or a portion of the organic-enhanced fraction is mixed with the larger-than-average fraction and this mixture is reground to a second predetermined average size. The particles of the regrind are again separated into larger and smaller than average fractions, the smaller of which is processed in a beneficiation process, again yielding an organic-enhanced fraction, and the larger of which is reground to a predetermined maximum size, along with all or a portion of the second beneficiation process. The product of the final grind is then processed in a suitable beneficiating process, resulting in an organic-enhanced yield substantially increased in both grade and percentage organic recovery. Additionally, the process permits significantly lowered energy consumption, resulting in a more cost-effective process, as well.

DETAILED DESCRIPTION OF THE INVENTION

The preferred feed of the present invention is oil shale of type normally found in the Western United States. Alternatively, however, the process may be used for beneficiating other organic-containing minerals, particularly coal, in ultra clean applications especially.

The raw oil shale is ordinarily precrushed prior to the grinding process to an appropriate mill feed size, about ¾" to 1" average diameter. The raw shale can be crushed using an impact crusher. The precrushed shale then mixed with water to aid the grinding process, to constitute an aqueous mixture of between about 40 to 65% solids, preferably around 50% solids. The precrushed shale/water mixture is then passed to the primary mill which may be a tumbling ball mill, a rod mill, autogenous mill or pebble mill or a combination. The preferred primary mill is a tumbling ball type, however, a combined tumbling ball/rod mill has also been effective.

During grinding, metal ions are released from the mineral component of the shale, primarily due to the temperature rise resulting from the mechanical grinding action. The metal ions, in turn, react with the organic component of the shale, flocculating the material into a gel-like state, and substantially increasing the viscosity of the feed. The more viscous the feed, the more difficult to grind to the desired fineness and the more energy is required. To control the rheology of the suspension, therefore, and reduce the energy and cost of grinding, a dispersant is added to the mixture. The dispersant can prevent the adverse effect of the metal ions and reduce the viscosity in either of two ways. First, the dispersant can act as a sequestering agent, reacting with the metal ions and taking them out of suspension. Preferred sequestering agents include phosphates, a most preferred phosphate for the present invention being sodium hexametaphosphate (SHMP). SHMP would ordinarily be added in a concentration of from about 0.05% to about 0.4% by weight of the solids, (2 lb/ton to 8 lb/ton) and preferably around 0.1% by weight.

Alternatively, dispersants may be used which prevent dissolution of the metal ions into the system in the first place. Preferred agents of this type are soluble metal carbonates, particularly sodium carbonate, sodium bicarbonates, soda ash, trona, or nacholite, which are mined mixtures of $Na_2CO_3$ and $NaHCO_3$. These carbonates or bicarbonates are ordinarily added to the grinding stage as aqueous solutions, but may also be added directly as solids. Preferred concentrations range from about 0.5% to 2.0% by weight, with about 1.0% more preferred.

Dispersants may also be added at other stages in the beneficiation process, and preferably should be the same dispersant throughout the system.

A variety of interdependent factors influence the reduction of the feed to the appropriate size distribution: residence time, ball charge, size distribution and weight, mill size, and mill revolution rates, among others. In a preferred embodiment of the first grinding stage, it is desired to reduce the ¼" or greater feed to an average 37 micron diameter, with a maximum of about 150 microns. Using an appropriately sized tumbling ball mill which may be from 8" to 25", a ball charge of standard balls of ½ inch or coarser, up to about 3 inch diameter is employed. The ball charge, size distribution and weight are a matter of some variation, but in general first stage, coarser particles are ground with larger average size balls, and the progressively finer the feed is to be ground in subsequent steps, the smaller the ball size distribution. The first-stage feed is tested as the grinding progresses for the appropriate feed size distribution. In the preferred embodiment above, average time required to reduce the feed to the desired fineness is approximately 10 minutes to 2 hours, more preferably 10 to 30 minutes.

Once ground to the desired first-stage fineness, the particles may be scrubbed to clean the surface of the particles and to break up adhering particles. A dispersant may also be added to assist the scrubbing, appropriate dispersants being the same or similar agents as used in the grinding step. It may also be desired within the scope of the invention to scrub the particles after classifying.

From the scrubber, it is necessary to classify or separate the particles into two sized fractions. In a preferred embodiment, one fraction will comprise particles larger than 37 micron average diameter, and the other fraction those particles smaller than 37 microns average. The particles may be classified using any standard classification device including cyclone classifiers, high frequency screens, filters, etc. Cyclone classifiers are the preferred method.

From the classifier, the smaller fraction may be scrubbed and passed to an organic beneficiation process for oil shale, one preferred beneficiation process would comprise conditioning the scrubbed shale using conditioning agents which increase the hydrophobicity of the kerogen-rich fraction of particles. Such collectors include pine oil, fuel oil, kerosene, and shale oil, which may be recycled from the process. A second conditioning agent, a frother, is also added to increase the frothing action during the froth flotation separation step. Appropriate frothers include carbonyls, particularly methylisobutylcarbonyl (MIBC), polypropylene glycol, phenols, short-chain alcoholic ethers, and pine oil. Dispersants previously discussed may also be added.

After conditioning the feed is separated using froth flotation in which air is bubbled through the mixture and the more hydrophobic kerogen-rich particles are floated to the surface by the air, while the kerogen-poor gangue remains in suspension. The froth concentrate is then removed from the surface, ordinarily by skimming. Multiple froth flotations may also be used.

An alternative preferred beneficiation method is to use selective flocculation to separate out a kerogen-rich fraction. In this method a flocculating agent is added to the scrubbed suspension which flocculates or coagulates either the kerogen-rich or the kerogen-poor fraction, preferably the former. Appropriate flocculating agents may be polymeric or non-polymeric, examples of each would include polyacrylamides, trade name Superfloc, manufactured by American Cyanamid Co., and citric acid. Other agents include other organic acids, phosphates, polymerized sulfonates, amines, amides, gums, starches, and silicates. The flocs formed are agitated and given sufficient residence time to reach a desired growth, after which the settled-out flocced layer is separated from the supernatent liquid. It may be separated by any conventional method, including sedimentation, eleutriation, and froth flotation.

The preferred beneficiation process may also include both separation processes, froth flotation and selective flocculation, sequentially in either order, and it may include multiple separations using each.

Upon separation, all or a portion of the kerogen-rich fraction of the beneficiation may be recycled to be included in the second and/or subsequent grinding steps.

The greater than average size shale fraction is taken from the classifier and may be dewatered in a dewatering cyclone. This fraction is then combined with the beneficiated, organic enhanced fraction and passed to a second grinding step.

In the second grinding stage, the larger-than-average fraction of the first grind is reground in a tumbling ball mill using a smaller ball size distribution than the first grinding step. Specifically, a preferred ball size distribution would be balls from ¼ inch or greater up to and including ½ inches in diameter, ordinarily with no more than 15% to 20% of which are as small as ¼" diameter. This medium size ball charged mill is run at a progressively slower speed than the first grinding stage, ordinarily from 20 to 70 rpm. The residence time in the mill is ordinarily from 10 minutes to 2 hours, preferably from 10 to 40 minutes. In a preferred embodiment, the desired fineness of the second grind is an average diameter of 37 microns. Once this size is reached, the ground product is again processed as the first-stage product was.

It is optionally scrubbed and passed to a classifier where it is separated into +32 and −37 micron fractions. The −37 fraction is then subjected to a beneficiation process like those taught above.

The greater than 37 micron fraction is dewatered and mixed with all or a portion of the organic-enhanced second beneficiation process product.

This mixture is then passed to a third, and preferably final, regrinding step. In the third grinding step, all of the remaining feed is ground to a fine, maximum average diameter, in a preferred embodiment from 6–10 microns. The grinding is achieved using an even smaller ball size distribution, and one not normally associated with oil shale processing. Specifically, 50% to 60% of which are ¼" in diameter, and a still slower mill revolution of from 20 to 60 rpm, preferably 30 to 45 rpm relative to mill diameter. Ordinarily, the grinding would take from 10 to 50 minutes to reach the desired fineness.

Finally, the product of the last grinding step is scrubbed and passed through a beneficiation process or processes, as taught above. Following concentration, the concentrate may be further upgraded by oil agglomeration using heavy oil such as fuel oil or shale oil. The oil agglomerates may then be dewatered by passing them over a dewatering device which separates the oil/kerogen from the water/gangue. The product may then be further processed by such methods as retorting, solvent extraction, hydrotreating, or other processes for producing a usable product.

It is to be understood that it is within the contemplated scope of the invention that the number of grinding steps is not to be limited but should be as many as necessary to effect the desired separation. Additionally, middlings or "off spec" shale may be recycled from the various beneficiation processes back to a preceding beneficiation stage.

What is claimed is:

1. A process for grinding organic-containing mineral comprising the steps:

(a) grinding said mineral matter in an aqueous medium to particles of a predetermined average size;

(b) separating said particles according to size into a larger-than-average fraction and a smaller-than-average fraction;

(c) processing said smaller-than-average fraction through a beneficiation process to produce an organic-enhanced fraction;

(d) regrinding said larger-than-average fraction to a second predetermined average size, with at least a portion of said organic-enhanced fraction from said beneficiation process;

(e) separating the particles of said regrinding according to size into a second larger-than-average fraction and a second smaller-than-average fraction;

(f) processing said second smaller-than-average fraction through a beneficiation process to produce a second organic-enhanced fraction;

(g) regrinding said second larger-than-average fraction to a predetermined maximum size with at least a portion of said second organic-enhanced fraction of said beneficiation process of step (b); and (h) passing said maximum-sized regrind to a beneficiation process.

2. The process as claimed in claim 1 wherein the mineral matter is oil shale.

3. The process as claimed in claim 1 wherein the mineral matter has been reduced to a size suitable for grinding prior to the initial step.

4. The process as claimed in claim 1 wherein the beneficiation processes are organic component beneficiation processes.

5. The process as claimed in claim 4 wherein each of the beneficiation processes comprise a scrubbing step, a separation step and an agglomeration/dewatering step.

6. The process as claimed in claim 5 wherein the separation step is a process selected from the group comprising froth flotation, selective flocculation and a combination of both.

7. The process as claimed in claim 1 wherein substantially all of each of the organic-enhanced fractions is added to the regrinding steps.

8. The process as claimed in claim 1 wherein the predetermined average size of the first grinding step is from 80 to 200 microns.

9. The process as claimed in claim 8 wherein the predetermined average size is about 150 microns.

10. The process as claimed in claim 1 wherein the second predetermined average size is from 20 to 50 microns.

11. The process as claimed in claim 10 wherein the second predetermined size is about 37 microns.

12. The process as claimed in claim 1 wherein a final predetermined maximum size is from 13 to 6 microns.

13. The process as claimed in claim 12 wherein the predetermined maximum size is about 10 microns.

14. The process as claimed in claim 1 wherein the grinding is done in tumbling ball mills or rod mills.

15. The process as claimed in claim 14 wherein the grinding is done in tumbling ball mills, wherein the average ball size distribution in the first grinding is from 3" to ½", in the second grinding from ¼" to 2", and in the final grind from ¼" to 1½".

16. The process as claimed in claim 14 wherein the mills are revolving mills, and the mill revolution rate in the first grinding is from 20 to 70 rpm, in the second grinding from 30 to 60, and in the final grinding from 30 to 50.

17. The process as claimed in claim 1 wherein the residence time of material in each grinding step is from 10 to 120 minutes in the first grinding step, from 10 to 40 minutes in the second grinding step, and from 10 to 50 minutes in the final grinding step.

18. The process as claimed in claim 1 wherein a dispersant is added to the grinding steps.

19. The process as claimed in claim 18 wherein the dispersant is selected from the group consisting of phosphates, carbonates, and bicarbonates.

20. The process as claimed in claim 18 wherein the dispersant is selected from the group consisting of sodium hexametaphosphate, soda ash, trona, nalcholite, sodium carbonate, sodium bicarbonate, and combinations thereof.

21. The process as claimed in claim 18 wherein the concentration of said dispersant is from about 0.04% to 3.0% by weight of solids.

22. The process as claimed in claim 21 wherein the concentration of said dispersant is about 0.1% to 1.0% by weight of solids.

23. The process as claimed in claim 1 wherein mineral middlings are produced from said beneficiation steps, and, said middlings are recycled to a preceding beneficiation step or a preceding grinding step.

* * * * *